United States Patent [19]

Satou et al.

[11] Patent Number: 4,838,956

[45] Date of Patent: Jun. 13, 1989

[54] METHOD OF PRODUCING A SPHEROIDAL GRAPHITE CAST IRON

[75] Inventors: Kazuo Satou; Ken Okazaki, both of Higashihiroshima, Japan

[73] Assignee: Mazda Motor Corporation, Hiroshima, Japan

[21] Appl. No.: 181,428

[22] Filed: Apr. 14, 1988

[30] Foreign Application Priority Data

Apr. 16, 1987 [JP] Japan ..... 62-95918
Apr. 16, 1987 [JP] Japan ..... 62-95919
Apr. 16, 1987 [JP] Japan ..... 62-95921

[51] Int. Cl.[4] ..... C21D 5/14
[52] U.S. Cl. ..... 148/3; 148/139
[58] Field of Search ..... 148/139, 3, 321

[56] References Cited

FOREIGN PATENT DOCUMENTS 271498 4/1987 European Pat. Off. .
54-133420 10/1979 Japan ..... 148/139
149428 7/1986 Japan .
61-149428 7/1986 Japan .

*Primary Examiner*—Deborah Yee
*Attorney, Agent, or Firm*—Wenderoth, Lind & Ponack

[57] ABSTRACT

Spheroidal graphite cast iron whose matrix is composed of a mixture of bainite and retained austenite, containing 250 to 800 graphite grains/mm$^2$, and its production method comprising the steps of forming the casting, annealing the casting so as to change the matrix to ferrite, machining the casting and subjecting the casting to austempering so as to subject the casting to austenitizing and isothermal transformation.

9 Claims, 3 Drawing Sheets

METHOD OF PRODUCING A SPHEROIDAL GRAPHITE CAST IRON

BACKGROUND OF THE INVENTION

The present invention relates to spheroidal graphite cast iron whose matrix is composed of a mixture of bainite and retained austenite, and a method of producing spheroidal graphite cast iron in which after a machining process has been performed, an austempering process for subjecting the casting to austenitizing and then, isothermal transformation is performed.

It is well known that in order to improve such mechanical properties as strength, toughness, fatigue strength, etc. of spheroidal graphite cast iron, it is remarkably effective therefor to change its matrix into a mixture of bainite and retained austenite by austempering. However, in this case, such a problem arises that since retained austenite in a state of lumps is precipitated by austempering, this retained austenite is changed into martensite during a machining process through its transformation induced by the machining process, thereby resulting in very poor machinability.

In order to obviate this problem of very poor machinability, it has also been conventionally so arranged that the machining process is performed prior to the austempering process. However, at the time of this machining, since the casting as cast has a large hardness, the casting is required to be initially annealed as primary heat treatment so as to have a ferritic matrix and then, is machined. Furthermore, in the case where after a casting has been machined, the casting is subjected to austempering, strain of the casting is produced at the time of a heating step and a cooling step of the austempering process. Therefore, in the case of a product requiring high accuracy, the product should be, after having been subjected to austempering, finished by machining or grinding. Meanwhile, as described above, since machinability of the casting deteriorates if the casting is subjected to austempering, finishing of the casting is quite troublesome, thus resulting in deterioration of its productivity and increase in production cost.

Therefore, if machinability of the casting subjected to austempering could be improved, it will be possible to raise productivity of the casting during the above described finishing process and reduce the production cost. For example, Japanese Patent Laid-Open Publication (unexamined) No. 149428/1986 proposes spheroidal graphite cast iron in which molten metal is rapidly cooled and solidified by using a metal mold or a mold provided partially with a chiller such that the number of graphite grains in the casting is increased, thereby improving machinability of the casting subjected to austempering. In this known casting method employing the metal mold or the mold provided partially with the chiller, it is surely possible to obtain the casting containing a great number of graphite grains. However, this known casting method has such a drawback that since chill is likely to be precipitated, addition of alloy elements, which is performed so as to obtain stable bainite structure through improvement of hardenability in isothermal transformation mainly for the purpose of improving strength of the casting, is restricted.

Meanwhile, in the case where spheroidal graphite cast iron is produced, there is a possibility that precipitation of chill having an excessively ill effect upon machinability and toughness of the casting occurs according to casting methods and casting conditions. When precipitation of chill occurs, the number of graphite grains usually decreases, so that segregation of alloy elements, precipitation of carbides having a large hardness, etc. are caused, thereby further hampering machinability of the casting.

As a countermeasure against deterioration of machinability due to precipitation of chill, there has been proposed so-called two-stepped annealing in which, in a first step, the casting is heated and held at a predetermined temperature higher than the $A_1$ transformation point for a predetermined time period prior to annealing in primary heat treatment performed after casting and prior to machining such that chill is decomposed and then, in a second step, the casting is heated and held at a predetermined temperature lower than the $A_1$ transformation point for a predetermined time period so as to be annealed. However, this prior method has such disadvantages that cost of heat treatment becomes high and a long time period is required for performing heat treatment.

Meanwhile, during production of spheroidal graphite cast iron, if graphitizing is promoted by a proper method such that the number of graphite grains per unit area of the casting is increased, a number of graphite grains having ferritic structure provided therearound are scattered in its matrix, so that precipitation of chill can be restricted and change of structure to ferrite can be performed relatively easily.

Meanwhile, during production of spheroidal graphite cast iron, inoculation is generally performed for the purpose of preventing occurrence of chill, promoting graphitizing, etc. Conventionally, in inoculation, a ladle inoculation method is employed in which inoculant is added to molten metal in a ladle before the molten metal is poured from the ladle into a mold. In this ladle inoculation method, since a time period from inoculation to solidification of the molten metal becomes long, effects of inoculation are lessened and thus, there is a possibility of precipitation of chill having an excessively ill effect upon machinability and toughness of the casting.

Therefore, it will be understood that if the ladle inoculation method is replaced by a pouring inoculation method in which inoculant is added to pouring molten metal which is being poured from the ladle into the mold, or an in-mold inoculation method in which inoculant is added to molten metal by filling the inoculant into a chamber formed in the course of a runner, the time period from inoculation to solidification of the molten metal is reduced, so that effects of inoculation are enhanced and thus, the number of graphite grains in the casting is increased, thereby resulting in restriction of precipitation of chill.

SUMMARY OF THE INVENTION

Accordingly, an essential object of the present invention is to provide spheroidal graphite cast iron having a matrix composed of a mixture of bainite and retained austenite, in which the number of graphite grains is increased through restriction of precipitation of chill having an ill effect upon strength and hardenability of the casting such that machinability of the casting subjected to austempering is improved, with substantial elimination of the disadvantages inherent in conventional spheroidal graphite cast irons of this kind.

Another important object of the present invention is to provide a method of producing spheroidal graphite cast iron, in which change of structure to ferrite is promoted by increasing the number of graphite grains in the casting and the cost of primary heat treatment can be reduced.

Still another object of the present invention is to provide a method of producing spheroidal graphite cast iron, in which the number of graphite grains in the casting is reduced by employing a proper inoculation method such that not only machinability of the casting as cast is improved but the cost of primary heat treatment is reduced.

In order to accomplish these objects of the present invention, spheroidal graphite cast iron having a matrix composed of a mixture of bainite and retained austenite, embodying the present invention, contains 250 to 800 graphite grains/mm$^2$.

BRIEF DESCRIPTION OF THE DRAWINGS

These objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Hereinbelow, spheroidal graphite cast iron in one aspect of the present invention is described in comparison with a comparative example having a number of graphite grains less than 250/mm$^2$. The spheroidal graphite cast iron is produced in the following sequence of processes, namely, (1) melting of casting stocks, (2) spheroidizing, (3) inoculation, (4) pouring, (5) primary heat treatment and (6) austempering. The above described step (3) inoculation is performed mainly for the purpose of preventing occurrence of chill and promoting graphitizing. Conventionally, a ladle inoculation method is generally employed for performing inoculation. However, in the present invention, in order to obtain a predetermined number of graphite grains stably, a pouring inoculation method or an in-mold inoculation method is employed.

Figures 1A, 1B, 1C, 1D:
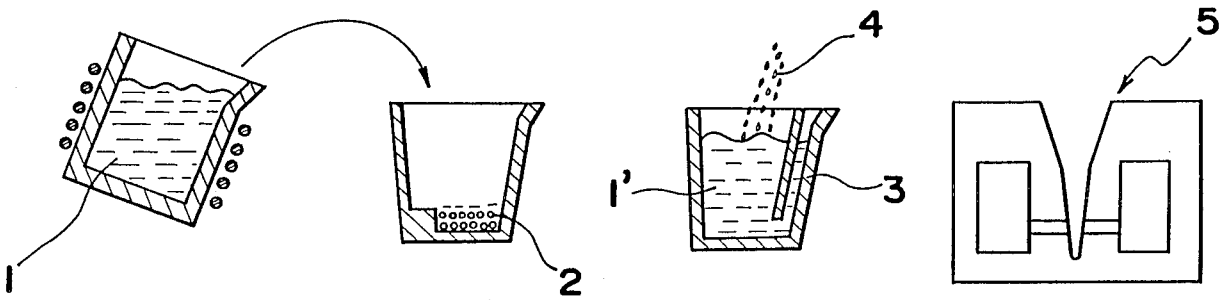
FIGS. 1*a* to 1*d* are schematic views explanatory of a ladle inoculation method.

Hereinbelow, the above described three inoculation methods are described with reference to FIGS. 1 to 3, respectively. In the ladle inoculation method, molten metal 1 is obtained by melting casting stocks as shown in FIG. 1*a* and then, is subjected to spheroidizing by using spheroidizing agent 2 as shown in FIG. 1*b*. Subsequently, as shown in FIG. 1*c*, the molten metal 1 is poured into a ladle 3 and inoculant 4 is added to the molten metal 1 in the ladle 3 from above the surface of the molten metal 1. The inoculant 4 has a grain size of 0.1 to 10 mm and the amount of the inoculant 4 added to the molten metal 1 is 0.3 to 0.6 wt. % of the molten metal 1. Then, as shown in FIG. 1*d*, molten metal 1' subjected to inoculation is poured into a mold 5 such that the molten metal 1' is cast.

Figure 2:
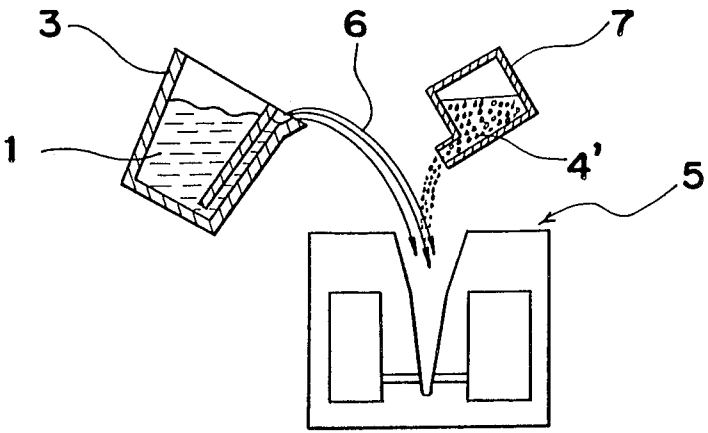
FIGS. 2 and 3 are schematic views explanatory of a pouring inoculation method and an in-mold inoculation method, respectively.
Figure 3:
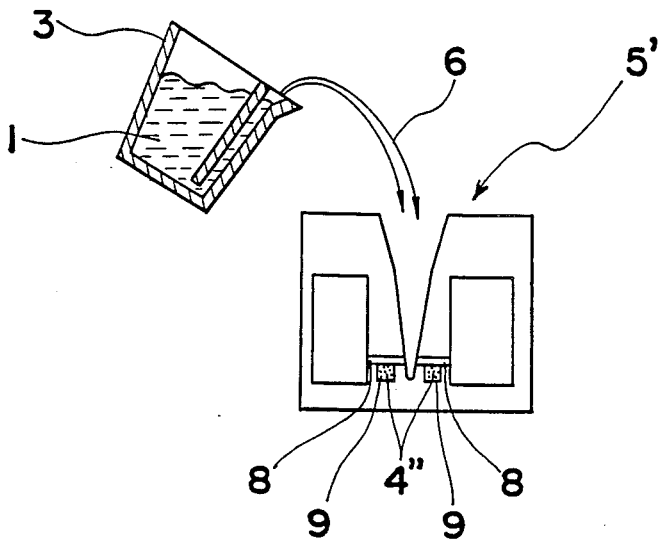

Meanwhile, in the pouring inoculation method, melting and spheroidizing are performed in the same manner as in the ladle inoculation method but as shown in FIG. 2, inoculant 4' is added, by using an inoculation apparatus 7, to pouring molten metal 6 obtained by pouring from the ladle 3 into the mold 5 the molten metal 1 not subjected to inoculation. At this time, the inoculant 4' has a grain size of 0.05 to 0.5 mm and the amount of the inoculant 4' added to the molten metal 1 is 0.1 to 0.25 wt. % of the molten metal 1.

In the in-mold inoculation method, two chambers 9 are provided in the course of two runners 8 of a mold 5', respectively and inoculant 4'' is preliminarily filled in the chambers 9 such that inoculation is performed in the mold 5' by pouring from the ladle 3 into the mold 5' the molten metal 1 not subjected to inoculation.

Various commercially available inoculants such as an Fe-Si series inoculant, or an inoculant obtained by adding Ca and $A_l$ to an Fe-Si series alloy, can be used for the above described inoculation methods.

In the above described three inoculation methods, the ladle inoculation method is most commonly used. However, in this embodiment, the pouring inoculation method or the in-mold inoculation method is employed in order to stably obtain 250 to 800 graphite grains/mm$^2$ throughout the casting. Even in the ladle inoculation method, if the cooling rate is sufficiently high, it is possible to obtain the casting containing not less than 250 graphite grains/mm$^2$ partially but it is difficult to obtain the casting containing not less than 250 graphite grains/mm$^2$ as a whole. Therefore, in order to ensure that not less than 250 graphite grains/mm$^2$ exist throughout the casting, one of the pouring inoculation method and the in-mold inoculation method, having greater inoculation effect than that of the ladle inoculation method, is employed in the present invention.

The primary heat treatment is performed for the purpose of decomposing chill and removing casting stress. In this embodiment, so-called two-stepped annealing is performed, namely, the casting as cast is heated and held at 920° C. for 2.5 h. and then, is heated and held at 730° C. for 3.5 h. and subsequently, is subjected to furnace cooling.

Meanwhile, austempering is performed for the purpose of changing the matrix to a structure composed of a mixture of bainite and retained austenite. In this embodiment, the casting having been subjected to primary heat treatment is heated and held at 890° C. for 1.5 h. so a to be subjected to austenitizing and then, is heated and held at 395° C. for 2.0 h. so as to be subjected to isothermal transformation.

Target composition rages, inoculation methods and actual chemical components of casting stocks A and B for producing spheroidal graphite cast iron according to embodiments of the present invention and that of a comparative example are shown in Table 1 below.

TABLE 1

| | | Target Composition Range | Stock A | Stock B |
|---|---|---|---|---|
| Chemical Component (wt. %) | C | 2.5–4.1 | 3.61 | 3.60 |
| | Si | 1.5–3.5 | 2.60 | 2.58 |
| | Mn | 0.3–1.0 | 0.52 | 0.51 |
| | P | ≦0.15 | 0.03 | 0.03 |
| | S | ≦0.03 | 0.010 | 0.009 |
| | Cu | 0.3–1.5 | 0.79 | 0.81 |

TABLE 1-continued

| | | Target Composition Range | Stock A | Stock B |
|---|---|---|---|---|
| | Mo | 0.27–0.5 | — | — |
| | Ni | 0.1–3.5 | — | — |
| | Mg | 0.005–0.08 | 0.043 | 0.039 |
| | Fe | Remainder | Remainder | Remainder |
| Inoculation Method | | — | Pouring Inoculation | Ladle Inoculation |

In Table 1, it is to be noted that at least one of Cu, Mo, and Ni is added as necessary in order to obtain stable bainite structure by securing hardenability at the time of isothermal transformation and in this embodiment, only Cu is added. Furthermore, it should be noted that all chemical components in Table 1 are expressed in wt. %.

By using the casting stocks A and B having chemical components shown in Table 1 above and employing the above described production method, castings of spheroidal graphite cast iron having thicknesses of 40 mm, 20 mm and 12 mm were produced. By using the casting stock A, three castings having the above described three thicknesses, respectively were produced. Meanwhile, by using the casting stock B, three castings having the above described three thicknesses, respectively were produced. Then, the number of graphite grains were measured in the castings having been subjected to austempering as shown in Table 2 below.

TABLE 2

| | Stock | Thickness (mm) | Number of graphite grains/mm$^2$ |
|---|---|---|---|
| Embodiment 1 | A | 12 | 760 |
| Embodiment 2 | A | 20 | 490 |
| Embodiment 3 | A | 40 | 320 |
| Embodiment 4 | B | 12 | 280 |
| Comparative Example 1 | B | 20 | 230 |
| Comparative Example 2 | B | 40 | 170 |

As will be seen from Table 2, in the castings of the casting stock A having been subjected to inoculation by the pouring inoculation method, the number of graphite grains exceeded 250/mm$^2$ in all the thicknesses. However, in the castings of the stock B having been subjected to inoculation by the ladle inoculation method, the number of graphite grains exceeded 250/mm$^2$ only in the casting having the smallest thickness of 12 mm. By comparing the castings of the casting stock A with those of the casting stock B of an identical thickness, it was found that the numbers of graphite grains in the castings of the casting stock B are not more than half of those of the casting stock A.

Figure 5:
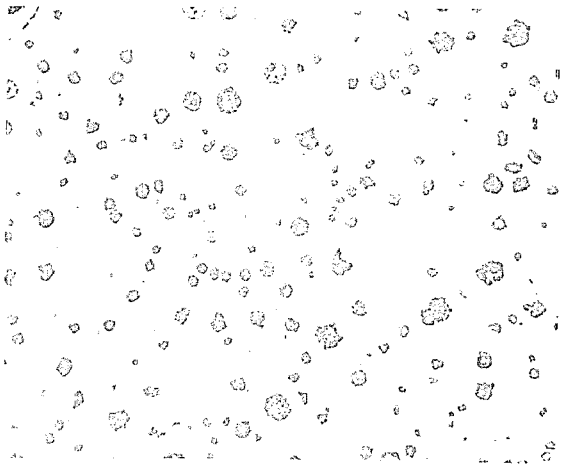
FIGS. 5 and 6 are micrographs of structures of two samples, respectively.
Figure 6:
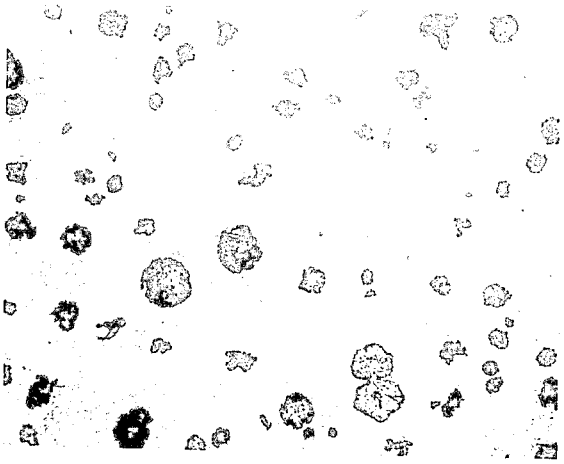

FIGS. 5 and 6 are micrographs (magnification = 100) of structures of the casting stocks A and B, respectively.

Figure 4:
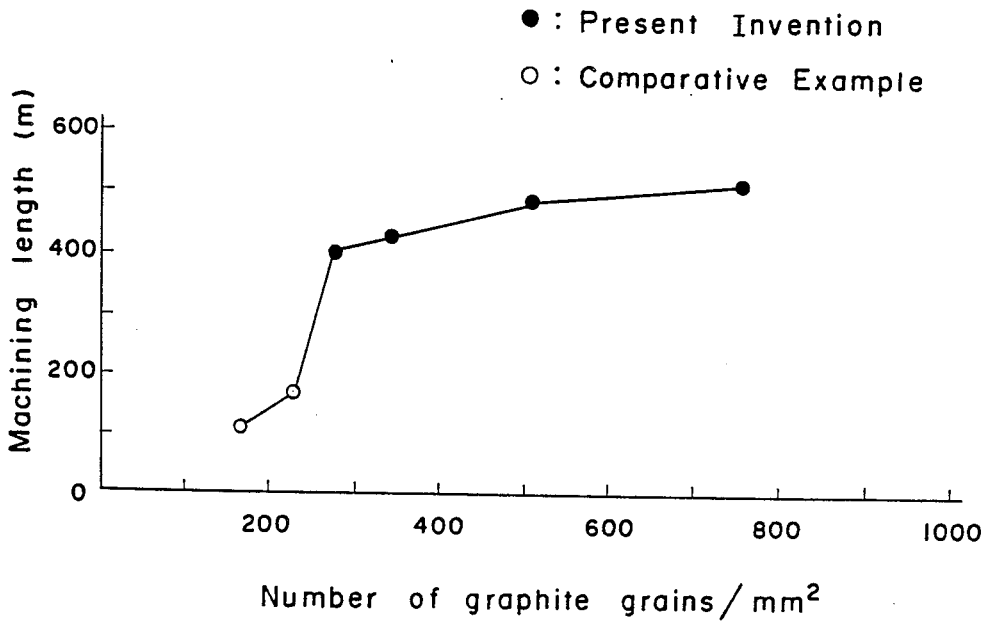
FIG. 4 is a graph showing the relation between the number of graphite grains and machinability.

From the above described results, four samples containing more than 250 graphite grains/mm$^2$ are referred to as castings of embodiments 1, 2, 3 and 4 of the present invention, respectively, while two samples containing less than 250 graphite grains/mm$^2$ are referred to as castings of comparative examples 1 and 2, respectively. These castings of the embodiments 1 to 4 of the present invention and the comparative examples 1 and 2 underwent the following machinability test. In the machinability test, test pieces of round rods were prepared from the castings of the embodiments 1 to 4 of the present invention and the comparative examples 1 and 2, respectively, and were subjected to cutting in which a machining length (m) up to the end of the service life of a cutting tool was measured for each of the test pieces. As shown in FIG. 4, machinability of the test pieces improves, namely the machining length of the test pieces increases as the number of graphite grains increased. Especially, in the test pieces of the embodiments 1 to 4 of the present invention having more than 250 graphite grains/mm$^2$, machinability is improved remarkably as compared with those of the comparative examples 1 and 2 having less than 250 graphite grains/mm$^2$. Meanwhile, it was found that when the number of graphite grains reaches approximately 800/mm$^2$, the effect of improving machinability exhibits its peak substantially.

As will be seen from the foregoing description, in accordance with the present invention, in the casting of spheroidal graphite cast iron whose matrix is composed of bainite and retained austenite, the number of graphite grains in the casting having been subjected to austempering ranges from 250 to 800/mm$^2$, so that segregation of Mn and retained austenite in a state of lumps, which deteriorate machinability of the casting, can be scattered into minute particles and thus, machinability of the casting having been subjected to austempering can be improved. In the casting of the present invention, the number of graphite grains is set at 250 to 800/mm$^2$ on the following grounds. Namely, if the number of graphite grains is less than 250/mm$^2$, a large amount of retained austenite in a state of lumps is precipitated at the time of austempering. This retained austenite is subjected to martensitic transformation at the time of machining so as to deteriorate machinability excessively. In addition, when the number of graphite grains is less than 250/mm$^2$, this small amount of graphite grains cannot produce an effect of improving machinability by scattering segregation of hard Mn into minute particles. Meanwhile, when the number of graphite grains exceeds 800/mm$^2$, an effect of improving machinability by scattering retained austenite in a state of lumps and segregation of Mn into minute particles does not exhibit further enhancement.

Furthermore, the casting of spheroidal graphite cast iron of the present invention contains 0.3 to 1.0 wt. % of Mn in order to improve its hardenability and mechanical properties. Since segregation of Mn can be scattered as described above, 0.3 to 1.0 wt. % of Mn can be added to the casting without hampering machinability, so that a stable bainite structure can be obtained by improving hardenability in isothermal transformation and thus, mechanical properties of the casting can be improved. In the casting of the present invention, the content of Mn is set at 0.3 to 1.0 wt. % on the following grounds. Namely, when the casting contains less than 0.3 wt. % of Mn, hardenability of the casting is insufficient. Meanwhile, when the casting contains more than 1.0 wt. % of Mn, segregation of Mn is likely to take place and thus, segregation of Mn cannot be scattered sufficiently due to the number of graphite grains.

Hereinbelow, a production method of producing a casting of spheroidal graphite cast iron containing not less than 250 graphite grains/mm$^2$, in another aspect of the present invention is described. In the production method of the present invention, the casting of spheroidal graphite cast iron containing not less than 250 graphite grains/mm$^2$ is prepared, then, the casting is annealed so as to change its matrix to ferrite, the casting is machined and finally, the casting is subjected to austempering for performing austenitizing and isothermal transformation.

It is desirable that the casting is heated and held at 700° to 750° C. for 0.5 to 8 h. in annealing. If the temperature is lower than 700° C., a long time period is required for changing the structure to ferrite. Meanwhile, when the temperature is higher than 750° C., annealing effect does not exhibit further enhancement. Meanwhile, if annealing is performed for less than 0.5 hr., change of structure to ferrite is insufficient. On the other hand, if annealing is performed for more than 8 h., annealing effect does not show further enhancement, thereby resulting in rise of annealing.

Meanwhile, austempering is performed desirably under the following conditions. Namely, the casting is heated and held at 800° to 950° C. for not more than 4 h. in austenitizing and the casting is held at 250° to 420° C. for not less than 15 min. in isothermal transformation.

In the production method of the present invention, the number of graphite grains is set at not less than 250/mm$^2$ for the following reasons. Namely, by setting the number of graphite grains at not less than 250/mm$^2$, the change of structure to ferrite can be promoted without precipitation of chill. Meanwhile, if the number of graphite grains is less than 250/mm$^2$, an effect of preventing precipitation of chill is lessened, thereby possibly resulting in deterioration of machinability of the casting and drop of toughness of the casting.

In the production method of the present invention, the pouring inoculation method or the in-mold inoculation method is employed so as to secure not less than 250 graphite grains/mm$^2$, so that the number of graphite grains in the casting as a whole can be set at not less than 250/mm$^2$ and the change of structure to ferrite can be promoted without precipitation of chill.

Meanwhile, if casting is performed by using a metal mold or a mold having a chiller provided on its surface, the casting containing a number of graphite grains can be obtained. However, in this casting method, since chill is apt to take place, the casting is required to be subjected to chill decomposing treatment for heating and holding the casting at a high temperature not less than the $A_1$ transformation point prior to annealing in primary heat treatment. Thus, the cost of the heat treatment rises and there is such a possibility that cavities formed around graphite grains by repeated heat treatment at a temperature not less than the $A_1$ transformation point will lower the Young's modulus of the casting.

Therefore, in the production method of the present invention, casting is performed by using a conventional sand mold. Thus, four samples of embodiments 1 to 4 of the present invention and two samples of comparative examples 1 and 2 were produced as shown in Table 3.

TABLE 3

| | Chemical composition (wt. %) | | | | | | |
|---|---|---|---|---|---|---|---|
| | C | Si | Mn | Mo | Ni | Mg | Fe |
| Embodiment 1 | 3.47 | 2.66 | 0.43 | 0.30 | 1.00 | 0.047 | Remainder |
| Embodiment 2 | 3.44 | 2.64 | 0.46 | 0.29 | 1.01 | 0.044 | Remainder |
| Embodiment 3 | 3.46 | 2.62 | 0.43 | 0.30 | 1.00 | 0.045 | Remainder |
| Embodiment 4 | 3.38 | 2.55 | 0.38 | 0.31 | 1.02 | 0.044 | Remainder |
| Comparative Example 1 | 3.53 | 2.78 | 0.41 | 0.31 | 1.02 | 0.043 | Remainder |
| Comparative Example 2 | 3.52 | 2.69 | 0.42 | 0.28 | 0.98 | 0.041 | Remainder |

In Table 3, the poring inoculation method is employed for the samples of the embodiments 1 and 2 and the in-mold inoculation method is employed for the samples of the embodiments 3 and 4, while the ladle inoculation method is employed for the samples of the comparative examples 1 and 2.

Meanwhile, an inoculant obtained by adding Ca, Al, Zr, Bi, rare earth elements, etc. to an Fe-Si series alloy containing 50 wt. % of Si or an Fe-Si series alloy containing 60 to 75 wt. % of Si can be used for inoculation in the reduction method of the present invention. In this experiment, 1 to 0.25 wt. % of an inoculant obtained by adding Ca and $A_1$ to the Fe-Si series alloy containing 60 to 75 wt. % of Si was used for the embodiments 1 to 4, while 0.3 to 0.6 wt. % of the same inoculant as that for the embodiments 1 to 4 was used for the comparative examples 1 and 2.

Chemical compositions (wt. %) of the samples of the embodiments 1 to 4 and the comparative examples 1 and 2 are as shown in Table 3.

Furthermore, regarding the respective samples as cast, vol. % of ferrite and pearlite in the matrix structure and the number of graphite grains/mm$^2$ were measured as shown in Table 4.

TABLE 4

| | Matrix structure (vol. %) | | Number of graphite grains/mm$^2$ |
|---|---|---|---|
| | Ferrite | Pearlite | |
| Embodiment 1 | 50 | 50 | 254 |
| Embodiment 2 | 50 | 50 | 263 |
| Embodiment 3 | 52 | 48 | 328 |
| Embodiment 4 | 55 | 45 | 412 |
| Comparative Example 1 | 20 | 80 | 154 |
| Comparative Example 2 | 25 | 75 | 194 |

It will be seen from Table 4 that the numbers of graphite grains in all the samples of the present invention employing the pouring inoculation method o the in-mold inoculation method exceed 250/mm$^2$ and the change of the structure of the samples of the present invention to ferrite is promoted remarkably as compared with the samples of the comparative examples 1 and 2.

Meanwhile, in the case of the samples of the embodiments 1 to 4 of the present invention, the casting as cast is heated and held at 730° C. for 3.5 h. so as to be subjected to annealing and then, is machined. Subsequently, the casting is heated and held at 890° C. for 1.5 h. so as to be subjected to austenitizing and then, is heated and held at 395° C. for 2.0 h. so as to be subjected to isothermal transformation.

On the other hand, in the case of the samples of the comparative examples 1 and 2, the casting as cast is subjected to two-stepped annealing in which the casting is heated and held at 920° C. for 2.5 h. and then, is heated and held at 730° C. for 3.5 h. Thereafter, the casting is machined and then, is subjected to austempering under the same conditions as those of the embodiments 1 to 4.

As will be seen from the foregoing description, in the production method of the present invention for producing the casting of spheroidal graphite cast iron subjected to machining prior to austempering, the number of graphite grains in the matrix of the casting is set at not less than 250/mm$^2$. Therefore, in accordance with the present invention, a large amount of graphite grains having ferritic structure provided therearound can be scattered so as to promote change of the matrix to ferrite and thus, change of the structure to ferrite can be effected relatively easily in annealing performed after casting and prior to machining. Consequently, the time period required for performing this annealing can be reduced and further, the annealing temperature can be dropped, so that energy consumption can be reduced and production cost of the casting can be decreased.

Meanwhile, in the production method of the present invention, since casting is performed by using a sand mold and the pouring inoculation method or the in-mold inoculation method having a marked inoculation effect is employed such that the casting as a whole contains not less than 250 graphite grains/mm$^2$, precipitation of chill having an excessively ill effect upon machinability and toughness of the casting can be prevented. As a result, chill decomposing treatment is not required to be performed in the primary heat treatment preceding machining, so that the cost of heat treatment can be reduced greatly and a drop in Young's modulus of the casting can be prevented.

Finally, a production method of producing a casting of spheroidal graphite cast iron containing not less than 250 graphite grains/mm$^2$, in still another aspect of the present invention is described, hereinbelow. In a first production method of the present invention, the casting of spheroidal graphite cast iron containing not less than 250 graphite grains/mm$^2$ is prepared and then, is machined. Subsequently, the casting is heated for austenitizing and then, is rapidly cooled so as to be subsequently subjected to isothermal transformation.

Furthermore, in a second production method of the present invention, the casting of spheroidal graphite cast iron containing not less than 250 graphite grains/mm$^2$ is prepared by adding inoculant to molten metal a the time of casting by the pouring inoculation method or the in-mold inoculation method and then, is heated and held at a temperature not more than the $A_1$ transformation point for 0.5 to 8 h. Subsequently, the casting is machined, then, is heated for austenitizing and then, is rapidly cooled so as to be subsequently subjected to isothermal transformation. Such conditions that the casting is heated and held at a temperature not more than the $A_1$ transformation point for 0.5 to 8 h. when the casting is subjected to primary heat treatment performed after casting and prior to machining are determined on the following grounds. Initially, the temperature is so set as to be not more than the $A_1$ transformation point for the following reason. Namely, in the production method of the present invention, since not less than 250 graphite grains/mm$^2$ is secured, precipitation of chill is prevented, so that chill decomposing treatment is not required to be performed and thus, the casting is not required to be heated to temperatures higher than the $A_1$ transformation point. In addition, if heat treatment is repeated at temperatures higher than the $A_1$ transformation point, Young's modulus of the casting drops. It is desirable that the temperature not more than the $A_1$ transformation point ranges from 700° to 750° C. Then, the time period is set at 0.5 to 8 h. for the following reason. Namely, if the time period is less than 0.5 h., the change of structure to ferrite is not performed sufficiently. Meanwhile, even if the time period exceeds 8 h., the treatment effect does not exhibit further enhancement, thereby resulting in mere rise of cost of primary heat treatment.

Meanwhile, desirable conditions of austempering are as follows. Namely, the casting is heated and held at 800° to 950° C. for not more than 4 h. in austenitizing, while the casting is held at 250° to 420° C. for not less than 15 min. in isothermal transformation.

By the production method of the present invention, four samples of embodiments 1 to 4 of the present invention and two samples of comparative examples 1 and 2 were produced. Since inoculation methods, chemical compositions, matrix structure, number of graphite grains/mm$^2$ and austempering, i.e. austenitizing and isothermal transformation, of the samples of the embodiments 1 to 4 and the comparative examples 1 and 2 are identical with those of Tables 3 and 4, the description thereof is abbreviated.

Test pieces in a shape of a round rod having a diameter of 45 mm and a length of 350 mm were prepared from the samples of the embodiments 1 to 4 and the comparative examples 1 and 2 and underwent a machinability test in which the service life of a cutting tool is measured by cutting an outer periphery of the rod. The cutting tool and cutting conditions used in the machinability test were as follows.

| | | |
|---|---|---|
| Cutting tool: | AC10G (Carbide tool coated with alumina) | |
| Cutting conditions: | | |
| Cutting speed | = | 120 m/min. |
| Feed rate | = | 0.4 mm/rev. |
| Depth of cut | = | 1.5 mm |
| Cutting oil | = | None (dry) |

Table 5 shows the service life of the cutting tool for the respective test pieces with the use of factors expressed relative to the service life of the test piece of the comparative example 1, which is set at 10 as a reference.

TABLE 5

| | Service life (Factor) |
|---|---|
| Embodiment 1 | 4.6 |
| Embodiment 2 | 3.9 |
| Embodiment 3 | 4.2 |
| Embodiment 4 | 5.1 |
| Comparative Example 1 | 1.0 |
| Comparative Example 2 | 1.3 |

It is seen from Table 5 that the test pieces of the embodiments I to 4 of the present invention have service lives remarkably longer than those of the comparative examples 1 and 2 and thus, machinability of the test pieces of the embodiments 1 to 4 are improved as compared with those of the comparative examples 1 and 2.

Accordingly, in the first production method of the present invention, since the pouring inoculation method or the in-mold inoculation method is employed at the time of casting, the time period from inoculation to solidification of the molten metal becomes short as compared with that of the ladle inoculation method which has been conventionally used. Thus, since the inoculation effect is enhanced, the number of graphite grains in the casting can be increased to not less than 250/mm$^2$. As a result, precipitation of chill can be restricted and change of the matrix structure to ferrite can be promoted, so that it becomes possible to prevent deterioration of machinability of the casting as cast and a drop in toughness of the casting as cast. Meanwhile, since segregation of alloy elements can be prevented, it becomes also possible to prevent a drop in toughness of the casting having been subjected to austempering.

Furthermore, in the second production method of the present invention, precipitation of chill can be prevented as described earlier. Hence, even when the casting is subjected to primary heat treatment prior to machining, chill decomposing treatment in which the casting is heated and held at a temperature not less than the $A_1$ transformation point is not required to be performed and thus, it is only necessary to perform low-temperature annealing in which the casting is heated and held at a temperature not more than the $A_1$ transformation point for 0.5 to 8 h. Therefore, the temperature of the heat treatment can be dropped and the time period of the heat treatment can be reduced, and production cost of the casting can be decreased through reduction of energy consumption. In addition, it becomes possible to prevent a drop in Young's modulus of the casting, which is caused by cavities formed around graphite grains due to repeated heat treatment at a temperature not less than the $A_1$ transformation point.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed a being included therein.

What is claimed is:

1. A method of producing spheroidal graphite cast iron, comprising the steps of:

providing a molten metal for a casting which contains 2.5–4.1 wt. % of carbon, 1.5–3.5 wt. % of silicon, 0.3–1.0 wt. % of manganese, not more than 0.15 wt. % of phosphorus, not more than 0.03 wt. % of sulfur, 0.005–0.08 wt. % of magnesium, at least one of 0.3–1.5 wt. % of copper, 0.27–0.5 wt. % of molybdenum and 0.1–3.5 wt. % of nickel, and a remainder of iron;

forming a casting of spheroidal graphite cast iron containing not less than 250 graphite grains/mm$^2$ from the molten metal while adding an inoculant to the molten metal by a pouring inoculation method or an in-mold inoculation method at the time of forming the casting;

annealing the casting by heating and holding the casting at a temperature of not more than the $A_1$ transformation point for 0.5 to 8 h. so as to change its matrix to ferrite;

machining the casting; and austempering the casting so as to subject the casting to austenitizing and isothermal transformation.

2. A method as claimed in claim 1, wherein the casting is subjected to austenitizing by heating and holding the casting at 800° to 950° C. for not more than 4 h. and is subjected to isothermal transformation by holding the casting at 250° to 420° C. for not less than 15 min.

3. A method as claimed in claim 1, wherein the inoculant is Fe-Si series inoculant or Fe-Si-Ca-Al inoculant.

4. A method as claimed in claim 1, wherein the casting is formed by using a sand mold.

5. A method of producing spheroidal graphite cast iron, comprising the steps of:

providing a molten metal for a casting which contains 2.5–4.1 wt. % of carbon, 1.5–3.5 wt. % of silicon, 0.3–1.0 wt. % of manganese, not more than 0.15 wt. % of phosphorus, not more than 0.03 wt. % of sulfur, 0.005–0.08 wt. % of magnesium, at least one of 0.3–1.5 wt. % of copper, 0.27–0.5 wt. % of molybdenum and 0.1–3.5 wt. % of nickel, and a remainder of iron;

forming a casting of spheroidal graphite cast iron containing not less than 250 graphite grains/mm$^2$ from the molten metal while adding an inoculant to the molten metal by pouring inoculation method or an in-mold inoculation method at the time of forming the casting;

annealing the casting by heating and holding the casting at a temperature of from 700° to 750° C. for 0.5 to 8 h. so as to change its matrix to ferrite;

machining the casting; and austempering the casting so as to subject the casting to austenitizing and isothermal transformation.

6. A method of producing spheroidal graphite cast iron, comprising the steps of:

providing a molten metal for casting which contains 2.5–4.1 wt. % of carbon, 1.5–3.5 wt. % of silicon, 0.3–1.0 wt. % of manganese, not more than 0.15 wt. % of phosphorus, not more than 0.03 wt. % of sulfur, 0.005–0.08 wt. % of magnesium, at least one of 0.3–1.5 wt. % of copper, 0.27–0.5 wt. % of molybdenum and 0.1–3.5 wt. % of nickel, and a remainder of iron;

forming a casting of spheroidal graphite cast iron containing not less than 250 graphite grains/mm$^2$, in which precipitation of chill is restricted, by adding an inoculant to the molten metal by a pouring inoculation method or an in-mold inoculation method;

machining the casting;

subjecting the casting to austenitizing by heating the casting;

rapidly cooling the casting;

subjecting the casting to isothermal transformation; and machining the casting.

7. A method as claimed in claim 6, wherein the casting contains 250 to 800 graphite grains/mm$^2$.

8. A method as claimed in claim 6, wherein the casting is subjected to austenitizing by heating and holding the casting at 800° to 950° C. for not more than 4 h. and is subjected to isothermal transformation by holding the casting at 250° to 420° C. for not less than 15 min.

9. A method as claimed in claim 6, wherein the inoculant is Fe-Si series inoculant or Fe-Si-Ca-Al series inoculant.

* * * * *